US006554413B2

(12) United States Patent
Kubota

(10) Patent No.: US 6,554,413 B2
(45) Date of Patent: Apr. 29, 2003

(54) INK SUPPLY MECHANISM, INK JET CARTRIDGE HAVING THE INK SUPPLY MECHANISM INSTALLED THEREON, AND INK JET RECORDING APPARATUS

(75) Inventor: Hidemi Kubota, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/565,744

(22) Filed: May 8, 2000

(65) Prior Publication Data

US 2003/0048340 A1 Mar. 13, 2003

(30) Foreign Application Priority Data

May 17, 1999 (JP) ..... 11-136007
Apr. 19, 2000 (JP) ..... 2000-117974

(51) Int. Cl.[7] ..... B41J 2/175
(52) U.S. Cl. ..... 347/87; 347/86
(58) Field of Search ..... 347/84, 85, 86, 347/87, 92, 93

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,457,485 A | | 10/1995 | Moriyama et al. | 347/92 |
| 5,481,289 A | * | 1/1996 | Arashima et al. | 347/93 |
| 6,082,852 A | * | 7/2000 | Soga et al. | 347/86 |

FOREIGN PATENT DOCUMENTS

| | | |
|---|---|---|
| JP | 59-123670 | 7/1984 |
| JP | 59-138461 | 8/1984 |

* cited by examiner

*Primary Examiner*—Ahn T. N. Vo
(74) *Attorney, Agent, or Firm*—Fitzpatrick, Cella, Harper & Scinto

(57) ABSTRACT

An ink supply mechanism, which is provided with an ink supply path to supply ink contained in an ink container to an ink jet recording head for recording images on a recording medium by discharging ink from discharge ports, comprises agitating means provided for the ink supply path for agitating ink flowing in the ink supply path. With the structure thus arranged, ink is supplied to the ink jet recording head in a state of being agitated by agitating means arranged in the ink supply path, thus making it possible to prevent the uneven concentrations of ink in an ink container left intact for a long time from appearing as the uneven densities of recorded images on a recording medium.

11 Claims, 8 Drawing Sheets

INK SUPPLY MECHANISM, INK JET CARTRIDGE HAVING THE INK SUPPLY MECHANISM INSTALLED THEREON, AND INK JET RECORDING APPARATUS

BACKGROUND OF THE INVENTION

1. Field of the Invention

The present invention relates to an ink supply mechanism that supplies ink from an ink container to an ink jet recording head. The invention also relates to an ink jet cartridge and an ink jet recording apparatus, which are provided with the ink supply mechanism.

2. Related Background Art

The recording apparatus, which is used as a recording apparatus for a printer, a copying machine, or a facsimile equipment, or which is used as an output device for a complex apparatus that includes a computer, a word processor, or for a work station, among some others. The recording apparatus is then structured to record images (including characters, symbols, or the like) on a recording material (a recording medium) such as a recording sheet or a thin plastic sheet (an OHP or the like).

The recording apparatuses thus structured are classified into various types, such as a ink jet type, a wire-dot type, a thermosensitive type, or a thermal transfer type, by a recording method of recording means adopted by each of them. Of those mentioned here, the recording apparatus of ink jet type (ink jet recording apparatus) is the one that records by discharging ink to a recording material from the recording head serving as recording means. This recording means is easily made compact, and also, with such compact head, highly precise images are made recordable at higher speeds. Here, among many other advantages, there is the one that recording is possible at a lower running cost on an ordinary recording sheet without any particular treatment given to it. Also, this apparatus is of non-impact type, making a lesser amount of noises, while producing color images with ease using multiple colors.

Here, in particular, the ink jet type recording means that discharges ink by the utilization of thermal energy makes it easier to manufacture the one having a highly precise arrangement of liquid paths (discharge ports) with the formation of the electrothermal transducing elements, electrodes, liquid path walls, ceiling plate, and others, which are provided on a substrate produced by means of film formation through etching, vapor deposition, sputtering, and other semiconductor manufacturing processes. Thus, the recording means is made compact still more in this manner. Also, utilizing the advantages of the IC technologies and the micromachining techniques the recording means can be elongated easily or its surfacing (two-dimensional arrangement) can be effectuated easily to make the recording means available in full multiple condition or to assemble it in a higher concentration.

The recording means of an ink jet recording apparatus described above is generally provided with an ink discharge unit that creates fine ink droplets; an ink supply unit that leads ink to the ink discharge unit; and an ink tank unit that stores ink in it. The ink tank unit is provided with a porous absorbent formed by urethane form or the like. Ink is absorbed and retained in such absorbent. Ink thus absorbed in the absorbent is not allowed to leak by means of the capillary force generated by the fine holes of the absorbent irrespective of the posture in which the ink jet recording head is placed. The ink tank is usable without staining the interior of the recording apparatus, the desk, the hands, or the like. Ink stored in an ink container of the kind is supplied to the recording head from the ink supply port provided for the ink container.

Nevertheless, with the ink tank thus structured, pigments are sedimented if the ink that uses pigments as colorants is stored in it for a long time, although there is no problem when the ink that uses dyestuffs as colorants is stored in it. Then, the uneven concentrations, that is, the concentrations that become different depending on locations, are caused to occur in the ink which is stored in the ink container.

Usually, the pigment ink is obtained by crashing finely the colorant which is insoluble to water after being mixed with copolymeric resin or the so-called interfacial active disperse agent, and then, diluted with water, oil, or some other solvent. The pigment particles themselves are not soluble to water. Therefore, when coated on a printed object, the pigment ink is superior to the dyestuff ink in terms of the water resistance. Further, the pigment particles withstand light well. As a result, the pigment ink is not discolored even if exposed to light for a long time. It demonstrates an excellent performance particularly with the printed object which should be shown on the wall or the like for a long time. This is because the pigment ink is widely used for general printed objects. However, although the fine solid particles, such as pigments, are allowed to float on liquid, its sedimentation should take place inevitably if the specific gravity thereof is greater than that of the solvent liquid (medium).

Here, the sediment speed of the particles can be expressed as follows:

$$u=2r^2(\rho_2-\rho_1)g/9\eta \quad (1)$$

where r is the radius of the particle which is assumed to be spherical; $\rho_1$ and $\rho_2$ are the concentrations of the particle and medium, respectively; g is the gravitational acceleration; and $\eta$ is the viscosity coefficient. The above expression (1) is called Stokes' formula.

Also, besides receiving the sedimental action brought by the gravity, the particles are influenced by the thermal motion of the medium molecules, thus continuing the Brawnian motion without interruption. By the Brawnian motion, there occurs the diffusion which is the action opposite to the sedimental one. With this diffusion, it is intended to implement the distribution of the particles uniformly.

The perpendicularly concentrated distribution of the pigment ink contained in an ink container is determined by the aforesaid sedimental action and the diffusion brought by the Brawnian motion. Now, given the concentration of pigment ink on the bottom of an ink container as Co, the concentration C at a height h from the bottom can be expressed as follows:

$$\ln (C/Co)=-4\pi r^3(\rho_2-\rho_1)g\cdot h/3kT \quad (2)$$

where r is the radius of the particle which is assumed to be spherical; $\rho_1$ and $\rho_2$ are the concentrations of the particle and medium, respectively; g is the gravitational acceleration; k is the Boltzman's constant; and T is the temperature of the pigment ink designated by the absolute temperature.

Now, for example, if the radius r of the particle is 200 nm; the temperature of ink T is 27° C.; the concentration of the particle $\rho_1$ is 1,400 kg/M$^3$; and the concentration of the medium $\rho_2$ is 1,000 kg/M$^3$, the ratio of concentration of 2% occurs per difference of 1 mm high. Also, if the viscosity of ink in this case is assumed to be 0.037 poise, it is calculated that the particle is sedimented to approximately 5 cm in two months, that is, the sedimental speed of the particle is worked out to be approximately 2.5 cm/month.

In practice, however, there is no appearance of such abrupt changes of concentration as indicated by the sedimental speed as described above. Conceivably, it is because of the constant convection current given to ink (liquid) stored in an ink container, which results in an even mixture eventually, and functions to prevent the occurrence of sediment of the particles.

In other words, the environment where an ink tank is kept is such as on a shelf in a room or in the interior of a printer located in a room. Therefore, an ink tank is always affected by the changes of the environmental temperature. The changes of the room temperature following the turning on and off of the air conditioning, and further, the temperature changes in the interior of a printer following the turning on and off of the printer power source may easily bring about the temperature changes of 40° C. to 50° C. Then, when a printer is on standby or in operation, the heat generation from the interior of the printer changes constantly following the turning on and off of a motor to drive the head, to enable the carriage to travel, and to carry a recording sheet, among some other operations. Therefore, the inner temperature is caused to change without interruption, which results in the repeated occurrence of the convection current in liquid stored in the ink tank placed under such environment. This has been reported in the publication "The fundamentals of the Colloid Chemistry p.35 and on" by Masayuki Nakagaki and Kiyonari Fukuda (New fundamental chemistry series (5) edited by Nippon Chemistry Institute, and published by Dai Nippon Publications).

However, the convection current is considerably impeded by the ink which is absorbed into the absorbent of the ink container. Thus, the resultant mixture that follows the constant convection current is made impossible so that the sediment is allowed to occur eventually. Consequently, the uneven concentrations take place in ink in a stationary ink container. Here, for the ink supply port of an ink container, a cylindrical filter is provided in order to prevent dust particles from entering the nozzles of a recording head. Then, the diameter of the portion where the filter is in contact with an absorbent is made larger to a certain extent in order to reduce resistance to the ink flow. As a result, if the ink container is stationarily placed for a long time in a state where the diameter of the filter is directed perpendicularly, the ink the concentrations of which differ in the diameter direction of the filter is allowed to flow toward nozzles. If the concentration of ink is different at the ink supply port as in this case, the resultant densities of ink become different eventually when discharged from each of the nozzles on the nozzle array, thus allowing the uneven prints to appear on the portion requiring a higher printing duty. In other words, the difference in the ink concentration at the ink supply port and the density of ink discharged from each of the nozzles of the nozzle array of a recording head correspond to each other after all, although the degree of this correspondence becomes lower on the printed portion of a lower duty, which is not easily recognizable as the uneven pints.

SUMMARY OF THE INVENTION

The present invention is designed in consideration of the technical problems discussed above. It is an object of the invention to provide an ink supply mechanism which makes it possible to prevent the uneven concentration of ink contained in an ink container left intact for a long time, thus preventing the unevenness of the recorded images. It is also the object of the invention to provide an ink jet cartridge and an ink jet recording apparatus, which use such ink supply mechanism.

In order to achieve the objects described above, the ink supply mechanism of the present invention, which is provided with an ink supply path to supply ink contained in an ink container to an ink jet recording head for recording images on a recording medium by discharging ink from discharge ports, comprises agitating means provided for the ink supply path for agitating ink flowing in the ink supply path.

With the structure thus arranged, ink is supplied to the ink jet recording head in a state of being agitated by agitating means arranged in the ink supply path even when uneven concentrations occur in ink stored in the interior of the ink container which is left in tact for a long time, thus making it possible to uniformalize the concentrations of ink discharged from each of the discharge ports of the discharge port array of the recording head, and to record good images on a recording medium without unevenness of densities thereof.

Also, it may be possible to arrange the structure so that a plurality of extrusion groups formed by plural extrusions arranged in the circumferential direction in the ink supply path are arranged for the aforesaid agitating means in the direction of the ink flow, and that each of the extrusions of the adjacent extrusion groups is arranged in a position deviated from each other in the direction of the ink flow.

Further it is preferable to structure the aforesaid extrusions sa as to create ink flow in the circumferential direction of the ink supply path.

Furthermore, it may be possible arrange the structure so that the aforesaid ink supply path is provided with a tapered ink inlet port on the end portion on the ink flow-in side, and each of the extrusions is arranged on the inner face of the ink inlet port.

Also, the structure may be arranged so that a plurality of agitation members, which are provided with flow paths partitioned in the form of latticework, are arranged for the aforesaid agitating means in the direction of ink flow in the ink supply path, and the agitation members adjacent to each other are arranged to enable the direction of each latticework thereof to be deviated from each other with respect to the circumferential direction of the ink supply path. The ink supply mechanism thus structured, the ink flow is divided by the latticework when ink passes a certain agitation member. Then, the ink flow thus divided is further divided when passing the next agitation member. Therefore, when ink passes the plural numbers of the agitation members, ink is agitated eventually.

Further, it is preferable to arrange the structure so that the deviated angle of each latticework of the agitation members adjacent to each other is form at an angle of approximately 45° in the circumferential direction of the ink supply path.

In addition, the structure may be arranged to provide the aforesaid ink container with an ink absorbent for absorbing ink.

Also, the aforesaid ink jet recording head may be structured to be provided with an electrothermal transducing element for generating thermal energy to be utilized for discharging the ink. Further, the structure may be arranged so that ink is discharged by the utilization of film boiling created by the thermal energy applied by the electrothermal transducing element.

Also, the ink jet cartridge of the present invention comprises an ink supply mechanism of the present invention described above, and an ink container that retains ink to be supplied to the ink jet recording head of the ink supply mechanism.

Further, it may be possible to arrange the structure so that the aforesaid ink container is provided with an ink absorbent for absorbing ink.

The ink jet recording apparatus of the present invention comprises the ink supply mechanism of the present invention described above, and driving signal supply means for supplying driving signals to enable the ink jet recording head to discharge ink therefrom.

Also, the ink jet recording apparatus of the present invention comprises the ink supply mechanism of the present invention described above, and recording medium carrying means for carrying the recording medium that receives ink discharged from the ink jet recording head.

Further, it may be possible to arrange the structure so that the ink jet recording apparatus of the present invention discharges ink from the ink jet recording head of the aforesaid ink supply mechanism to record images on the recording medium by the adhesion of ink thereto.

DETAILED DESCRIPTION OF THE PREFERRED EMBODIMENTS

Hereinafter, with reference to the accompanying drawings, the description will be made of the embodiments in accordance with the present invention.

Figure 1:
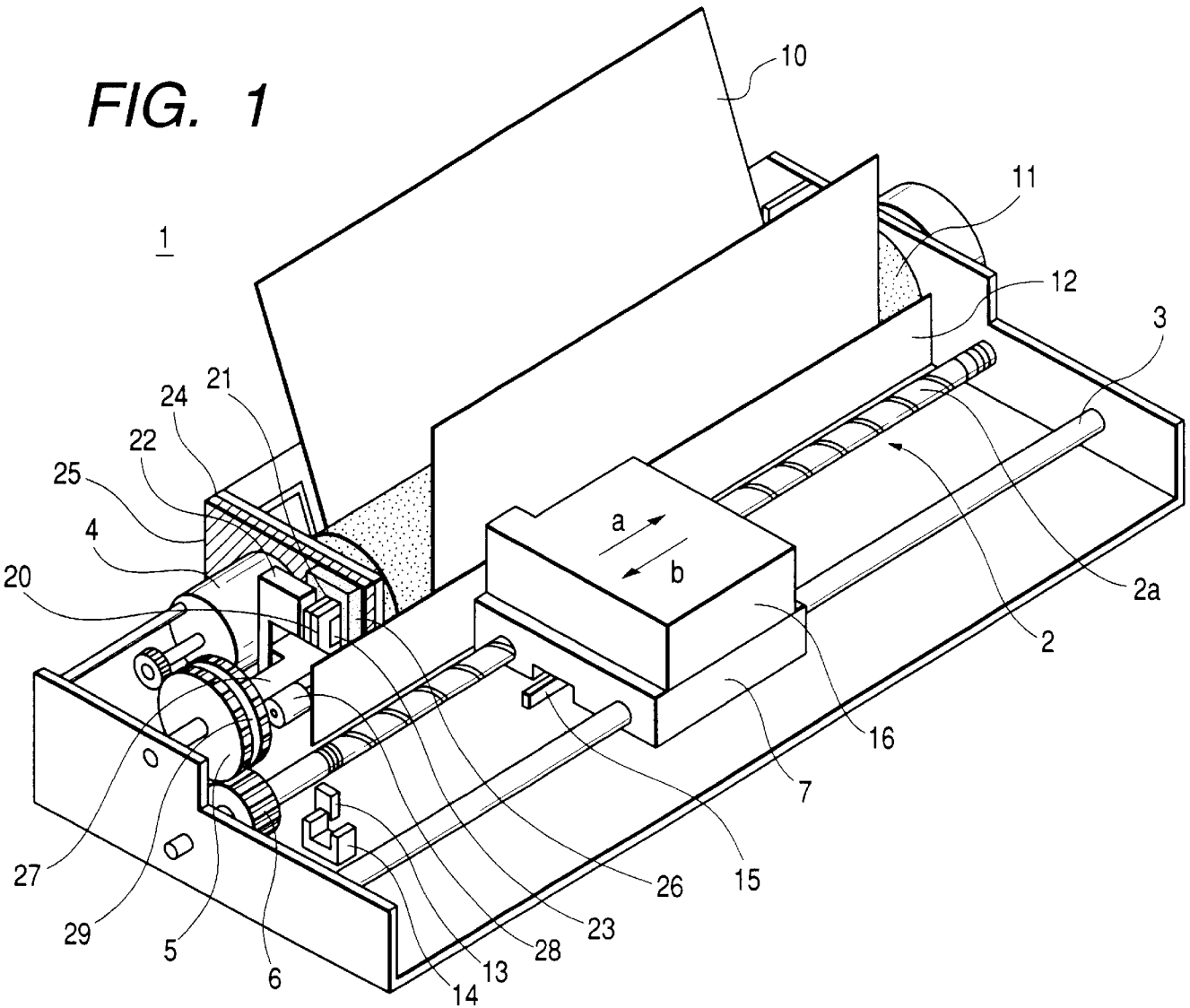
FIG. 1 is a perspective view which schematically shows the structure of the ink jet recording apparatus to which the ink supply mechanism is applicable in accordance with one embodiment of the present invention.

FIG. 1 is a perspective view which schematically shows the structure of the ink jet recording apparatus to which the ink supply mechanism is applicable in accordance with one embodiment of the present invention.

As shown in FIG. 1, a lead screw 2 having a spiral groove 2*a* cut thereon is rotatively supported axially by the ink jet recording apparatus 1 of the present embodiment. The lead screw 2 is interlocked with the regular and reverse rotations of a driving motor 4, and driven to rotate through the transmission gears 5 and 6. A pin (not shown) provided for the supporting member 8 (see FIG. 6) of the carriage 7 engages with the spiral groove 2*a*. Then, the carriage is slidably guided by the guide rail 3 to reciprocate by the regular and reverse rotations of the driving motor 4 in the directions indicated by arrows a and b. In this respect, the driving mode of the carriage 7 is not necessarily limited thereto. It is of course possible to adopt any other structure, such as a belt driving, which is generally known.

The recording material 10 which is a recording medium formed by a recording sheet, a thin plastic sheet, or the like is carried by means of a platen roller 11, and pressed to the circumferential surface of the platen 11 by the sheet pressure plate 12 which extends in the carriage traveling direction in the recording position. The recording material 10 is carried on the platen 11 by means of the recording medium carrier device which is not shown. The photocouples 13 and 14 provide home position detecting means to confirm the presence of the lever 15 of the carriage 7 in this region, and then, enable the driving motor 4 to rotate regularly or reversely, among some other operations. On the carriage 7, the ink jet cartridge 16 which forms recording means is mounted. Then, as shown in FIG. 3, the structure is arranged for the ink jet cartridge 16 so that the ink jet unit 18 including the ink jet recording head 17, and the ink tank 19 which forms the ink container are integrally structured together.

Figure 3:
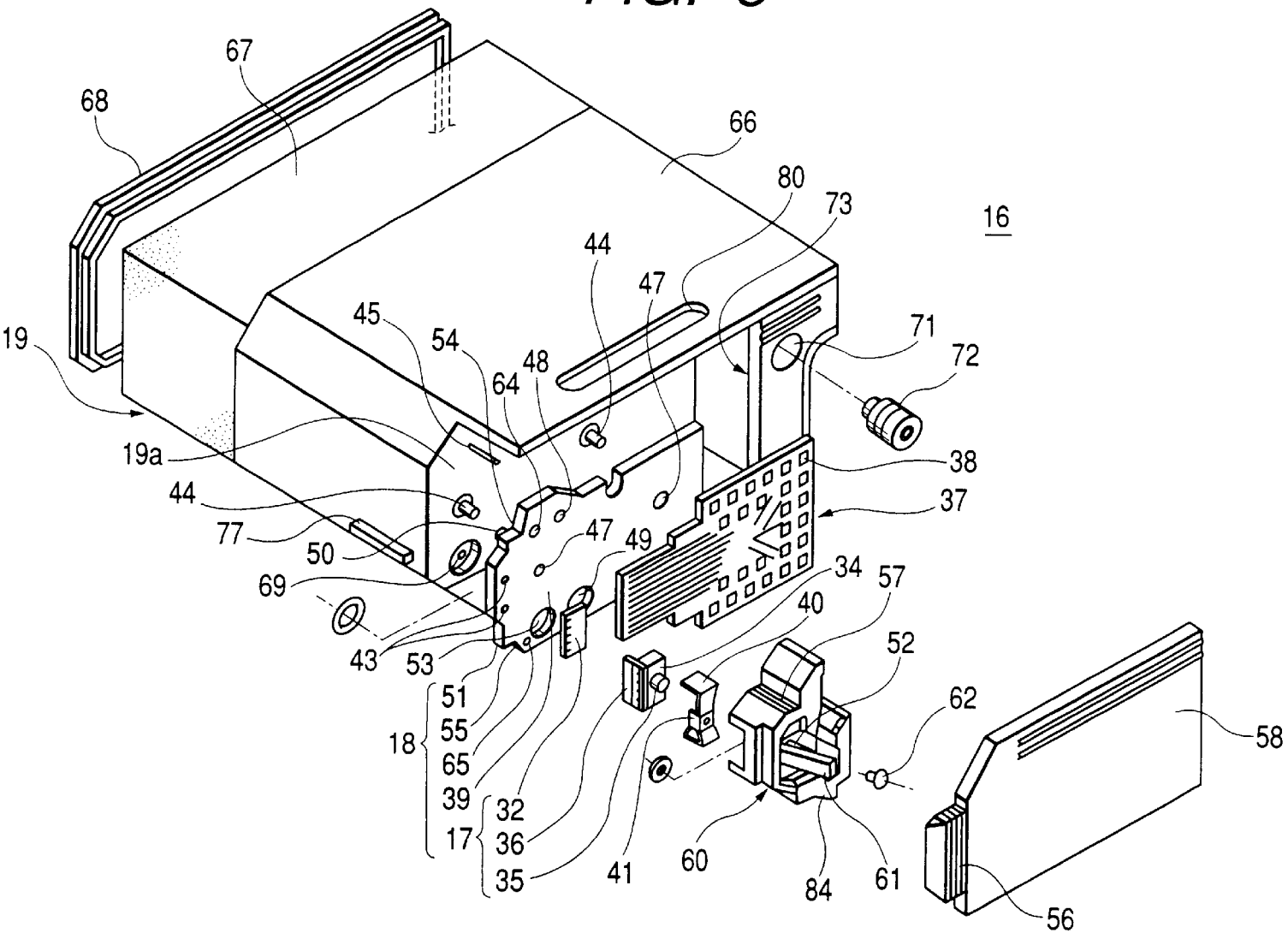
FIG. 3 is an exploded perspective view which shows the ink jet cartridge represented in FIG. 1 and FIG. 2.

In a position other than the recording area (the home position, for instance), the capping member 20 is arranged to cover (cap) the discharge port surface (that is, the front face where discharge ports are arranged) of the ink jet recording head 17 (see FIG. 3). The capping member 20 is supported by a supporting member 21. The capping member 20 is further provided with suction means 22 so that it is structured to perform the suction recovery for the ink jet recording head 17 through the cap inner aperture 23.

On the frame member 24 of the recording apparatus 1, a supporting plate 25 is installed. Then, a cleaning blade 26 is slidably supported by the supporting plate 25, and made movable forward and backward by the driving means which is not shown with respect to the ink jet head 17. As the cleaning blade 26, any one of those in the publicly known mode is adoptable, besides the one shown in FIG. 1. The lever 27 is used to initiate a suction recovery operation, which moves along the movement of the cam 28 that abuts against the carriage 7. Then, along with the movement of the lever 27, the gear 29 and known transmission means, such as changing a clutch, are controlled so that the transmission of the driving power from the driving motor 4 is controlled. The capping, cleaning, and each process of the suction recovery operation are performed by the function of the lead screw 2 in each of the corresponding positions when the carriage arrives at a specific region on the home position side. Then, each of these processes is executable in an arbitrary mode by the utilization of the known timing and sequence. Also, each of these processes can be performed individually or complexly.

In this respect, although not shown in FIG. 1, the ink jet recording controlling unit is provided for the main body of the recording apparatus 1 to provide driving signals for each of the electrothermal transducing elements 31 (see FIG. 4) installed on the recording head 17 (see FIG. 2) or to operate driving control of each mechanisms described above. The recording apparatus 1 thus structured performs image recording on the recording material 10 carried onto the platen 11 by means of the recording medium carrying device, while the recording head 17 reciprocates over the entire width of the recording material 10.

Figure 2:
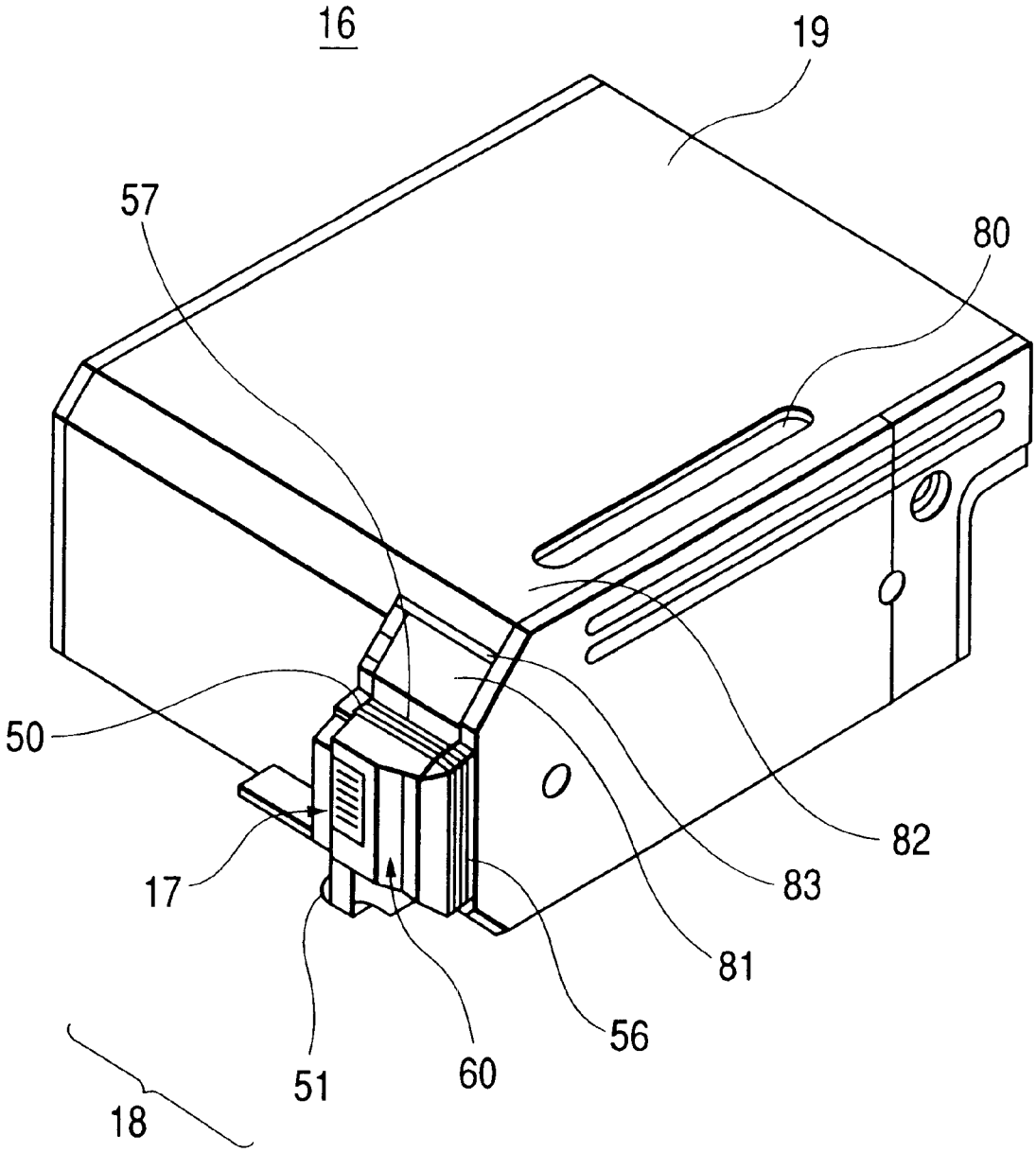
FIG. 2 is a perspective view which shows the outer appearance of the ink jet cartridge represented in FIG. 1.

Now, FIG. 2 is a perspective view which shows the outer appearance of the ink jet cartridge represented in FIG. 1. FIG. 3 is an exploded perspective view which shows the ink jet cartridge represented in FIG. 1 and FIG. 2.

As shown in FIG. 2 and FIG. 3, the ink jet cartridge 16 is formed by the ink jet unit 18 that includes the ink jet recording head 17 and the ink tank 19 that contains ink to be supplied to the recording head 17, which are assembled together. Then, for the ink jet recording head 17, many numbers of discharge ports 30 are formed integrally. The ink jet unit 18 includes the ink jet recording head 17, and the electric wiring, the ink piping, and the like needed for the operation of the ink jet recording head 17 are assembled together as the unit. The ink jet cartridge 16 of the present embodiment has a comparatively large ink containing ratio. The leading end of the ink jet unit 18 is slightly extruded from the front face of the ink tank 19. The ink jet cartridge (recording means) 16 is of the disposable type which is fixedly supported by the carriage 7 to which it is detachably mountable by use of positioning means of the carriage 7 and the electrical contact points as described later in conjunction with FIG. 6.

Now, the structure of the ink jet recording head 17 will be described.

Figure 4:
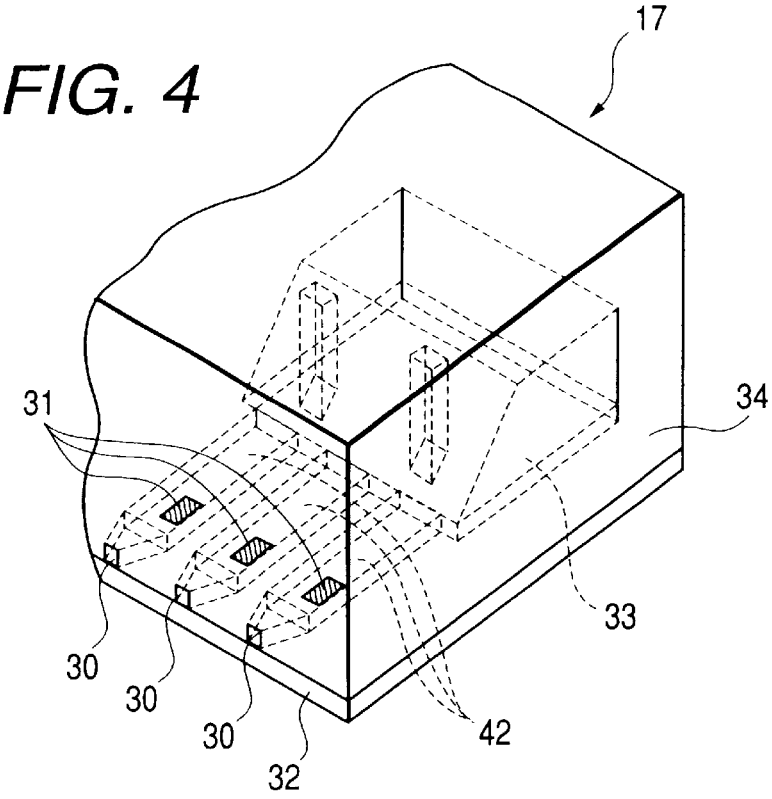
FIG. 4 is a partly perspective view which shows schematically the structure of the ink jet recording head represented in FIG. 2.

FIG. 4 is a partly perspective view which shows schematically the structure of the ink jet recording head represented in FIG. 2.

The ink jet recording head 17 is an ink jet recording head that discharges ink by the utilization of thermal energy, and provided with the electrothermal transducing elements 31 that generates thermal energy. Also, the recording head 17 performs recording by discharging ink from the discharge ports 30 by the utilization of the pressure changes made by the development and contraction of bubbles brought by film boiling created by the application of the thermal energy generated by the electrothermal transducing elements 31.

As shown in FIG. 4, the electrothermal transducing elements 31, each generating thermal energy with the applied voltage supplied to it, are arranged per ink liquid path 42, respectively, for the ink jet recording head 17 in order to discharge ink from a plurality of discharge ports 30 arranged in line. Then, in accordance with recording signals from the control circuit (not shown) provided for the main body of the recording apparatus, the driving signals are selectively applied to each of the electrothermal transducing elements 31 to create film boiling with the thermal energy thus generated by the electrothermal transducing elements 31. In this manner, bubbles are formed in each of the ink flow paths 42 and developed for discharging ink droplets from each of the discharge ports 30.

Each of the electrothermal transducing elements 31 is provided for the heater board 32 which is formed by a silicon substrate, and integrally formed by the film formation techniques with the wiring (not shown) of aluminum or the like that supplies electric power to each of the electrothermal transducing elements 31. There are integrally formed the ceiling plate 34 provided with the partition walls to divide a plurality of ink flow paths 42, respectively, and a common liquid chamber 33 and others to temporarily retain ink to be supplied to each of the ink flow paths 42; the ink receiving port 3 (see FIG. 3) to induce ink from the ink tank 19 to the common liquid chamber 33 and other; the discharge port plate (a plate where the discharge port surface is formed) 36 having a plurality of discharge ports 30 corresponding to each of the ink flow paths 42. For this integrated body, it is preferable to use polysulfone as the material thereof, but it may be possible to use some other molding resin material, such as polyether sulfone, polyphenylen oxide, polypropylene.

Now, the structure of the ink jet unit 18 will be described.

As shown in FIG. 3, one end of the wiring substrate 37 is connected with the wiring portion of the heater board 32 of the ink jet head 17 each other. Then, a plurality of pads 38 corresponding to each of the electrothermal transducing elements 31 (see FIG. 4) to receive electric signals from the main body of the recording apparatus 1 are arranged for the other end of the wiring substrate 37. In this manner, the electric signals from the main body of the recording apparatus 1 are supplied to each of the electrothermal transducing elements 31 individually. The metallic supporting member 39 that supports on the plane of the reverse side of the wiring substrate 37 is arranged to serve as the bottom plate of the ink jet unit 18.

The pressure spring 40 is formed in an M-letter shape to press slightly the outer wall portion of the common liquid chamber 33 (see FIG. 4) with the central portion of the M-letter shape thereof. At the same time, the pressure spring compresses a part of the flow paths 42 or, preferably, the area close to the discharge ports 30 intensively with the apron portion 41 thereof under linear pressure. The heater board 32 and the ceiling plate 34 are allowed to engage with each other in a state of being sandwiched between the supporting member 39 and the pressure spring 40 and fixed under pressure exerted by the pressure spring 40 together with the intensive biasing force exerted by the apron portion 41 thereof when the foot section of the pressure spring 40 engages with the reverse side of the supporting member 39 through the hole 43 of the supporting member 39.

The supporting member 39 is provided with the holes 47, 48, and 49 which engage with the two extrusions 44 for use of positioning the ink tank 19 and the extrusions 45 and 46 (see FIG. 5) for use of thermofusion holding. Besides, the supporting member has the extrusions 50 and 51 on the reverse side thereof for use of positioning carriage 7. Also, for the supporting member 39, a hole 53 is provided to enable the ink supply tube 52 that forms the ink supply path, and the ink tank 19 to pass it through. The wiring substrate 37 is bonded to the supporting member 39 for the installation thereof using a bonding agent or the like. The recessed portions 54 and 55 of the supporting member 39 are provided in the vicinity of the extrusions 50 and 51 described above, and the structure is arranged so that dust particles and ink, which are not needed do not reach the extrusions 50 and 51 by positioning such recessed portions on the extended lines of the parallel grooves 56 and 57 arranged for the three sides on the circumference of the unit 18 of the assembled ink jet cartridge 16.

Figure 6:
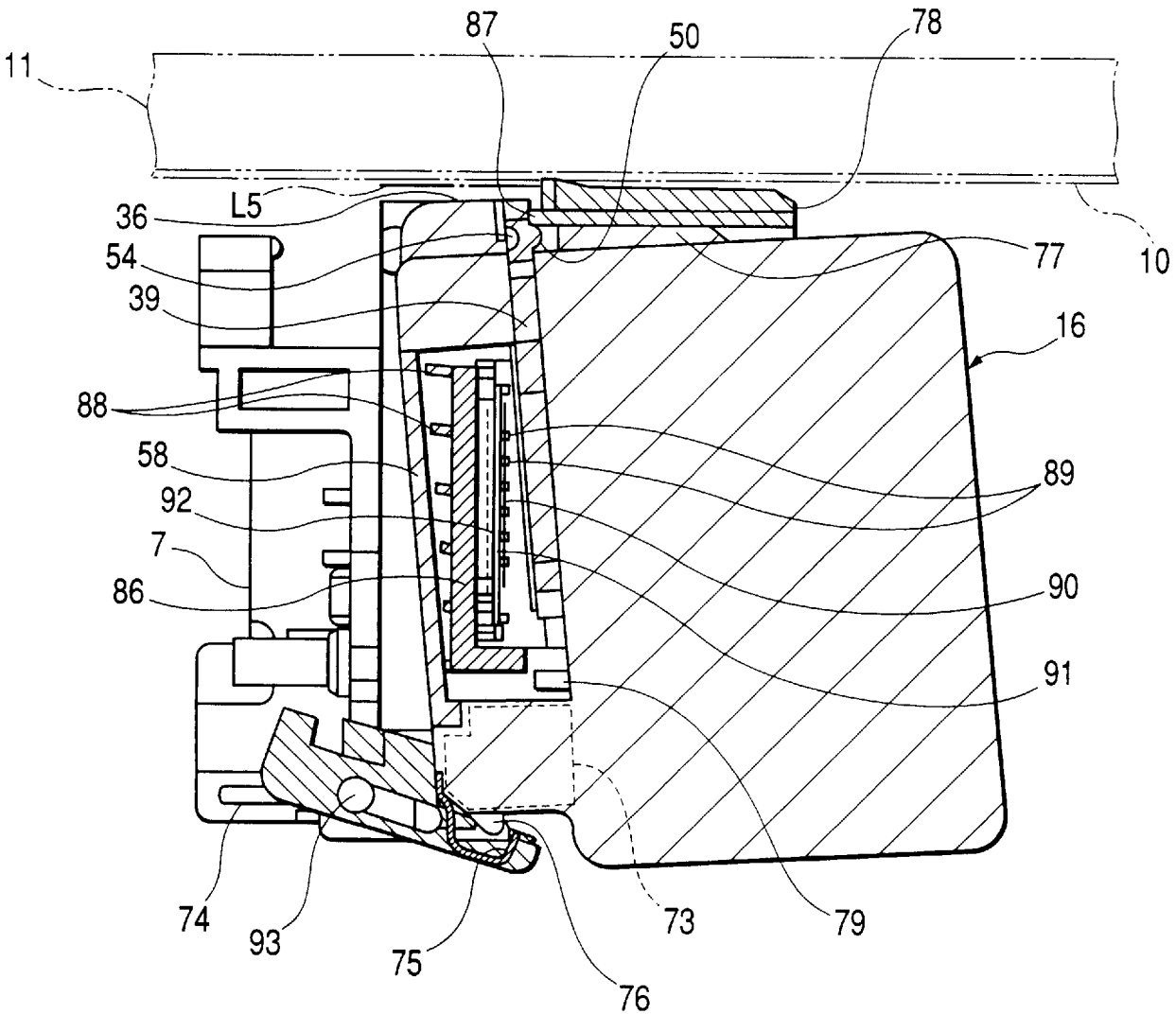
FIG. 6 is a cross-sectional view which shows the installation structure of the ink jet cartridge for the carriage.

The cover member 18 having the parallel grooves 56 formed therefor forms the outer walls of the ink jet cartridge 16 as shown in FIG. 6, and at the same time, it forms a gap 59 with the ink tank 19 where the ink jet unit 58 is located. Also, referring to FIG. 3 again, the ink supply member 60, which forms the ink supply mechanism to supply ink contained in the ink tank 19 to the ink jet recording head 17, is structured in a cantilever fashion with its ink supply tube 52 side being fixed, and also, provided with the ink conduction tube 61 which is connected continuously with the ink supply tube 52. Further, a sealing pin 62 is inserted into this member in order to secure the capillary phenomenon between the fixed side of the ink conduction tube 61 and the ink supply tube 52. Here, the coupling portion between the ink tank 19 and the ink supply tube 52 is press fitted for sealing. Also, the parallel grooves 57 are formed for the ink supply member 60.

Now that the ink supply member 60 is formed by molding, this member is inexpensive, but its positional accuracy is high. Then, the precision of the member is not lowered when manufactured. For example, the pressurized state of the ink conduction tube 61 in contact with the ink receiving port 35 is made stable because the dimensional precision of each part of the ink supply member 60 is high. In accordance with the present embodiment, it becomes possible to obtain the exact state of communication more securely just by letting the bonding agent for use of sealing run from the ink supply member 60 side under condition of pressurized contact. Here, the fixation of the ink supply member 60 to the supporting member 39 can be made simply by letting the two pins (not shown) on the reverse side of the ink supply member 60 pass through the holes 64 and 65 of the supporting member 39, and then, by thermofusing these pins. The slightly extruded area on the reverse side where the thermofusion is conducted is retained fittingly on the recessed portion (not shown) on the side face of the ink tank 19 side where the ink jet unit 18 is installed. Therefore, the positioning surface of the ink jet unit 18 can be obtained exactly.

Now, the structure of the ink tank 19 will be described.

As shown in FIG. 3, the ink tank 19 is fundamentally formed by the cartridge main body 66, the ink absorbent 67, and the cover member 68. After the ink absorbent 67 is inserted into the cartridge main body 66 from the side opposite to the ink jet unit 18, the cover member 68 seals them to complete the assembling. The ink absorbent 67 absorbs ink and holds it, which is arranged in the interior of the cartridge main body 66. The ink supply port 69 is the one through which ink is supplied to the ink jet unit 18, and the filter 70 (see FIG. 7) is provided slightly inside this port. Further, for the ink tank 19, the atmospheric communication port 71 is provided to communicate the interior thereof with the air outside. Inside the atmospheric communication port 71, a liquid repellent material 72 to prevent the ink leakage from the atmospheric communication port.

For the ink jet cartridge 16 of the present embodiment, the structure is adopted to make it possible to minimize the space needed for assembling, while maximizing the containable amount of ink, by making the rear side face flat to the ink jet head 17. Therefore, not only the recording apparatus 1 can be made compact, but also, the exchanging frequency of the cartridges 16 can be reduced. Then, by the utilization of the rear portion of the space arranged for joining the ink jet unit 18 together, the extruded portion for accommodating the atmospheric communication port 71 is formed, and the interior of such extruded portion is made hollow to provide the space 73 for supplying the atmospheric pressure corresponding to the whole thickness of the ink absorbent 67 which has been described earlier. With the structure thus adopted, it becomes possible to obtain an excellent ink jet cartridge 16.

Here, the space 73 for supplying the atmospheric pressure is far larger than the one conventionally available. Then, the atmospheric communication port 71 is positioned above this space and keeps ink temporarily in the space 73 for supplying the atmospheric pressure even if ink should be released from the ink absorbent 67 unexpectedly by the occurrence of an abnormal event. Ink is collected to the ink absorbent 67 reliably, thus providing an excellent ink jet cartridge 16 capable of using ink without any waste.

Figure 5:
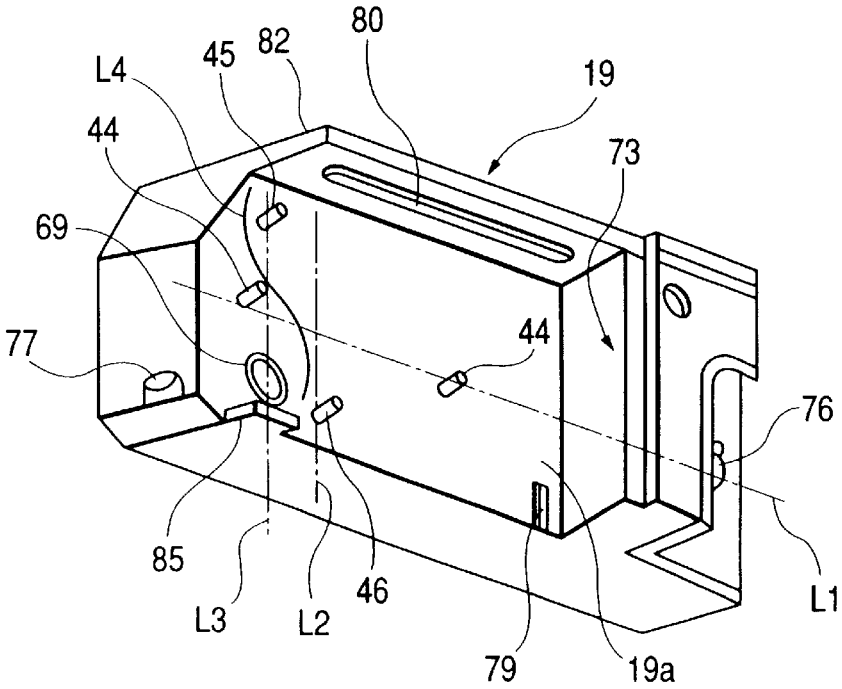
FIG. 5 is a perspective view which shows the installation surface of the ink jet unit for the ink tank represented in FIG. 3.

Now, with reference to FIG. 5 and FIG. 3, the description will be made of the structure of the ink jet unit installation portion 19*a* of the ink tank 19. FIG. 5 is a perspective view which shows the ink jet unit installation surface of the ink tank represented in FIG. 3.

On the ink jet unit installation surface 19*a* of the ink tank 19, the straight lines parallel to the installation referential plane of the bottom face of the ink tank 19 or the surface of the carriage 7, which run through almost each center of the discharge ports 30 of the discharge port plate 36, is defined as L1. Then, the two positioning extrusions 44 that engage with the two holes 47 of the supporting member 39 are located on these straight lines L1, respectively. The height of each of the two extrusions 44 is slightly smaller than the thickness of the supporting member 39. These are used for positioning the supporting member 39.

On the extended straight line L1, the nail 76 is arranged as shown in FIG. 6, with which engages the 90-degree coupling face 75 of the hook 74 for use of positioning the carriage 7. Then, the structure is arranged so that its positioning action works for the carriage 7 on the surface region which parallel to the aforesaid referential plane that includes the straight line L1. With the relations thus made in this respect, an effective structure is presented as described later in order to make the positioning accuracy, which is provided only for the ink tank 19, equal to the positioning accuracy of the discharge ports 30 of the ink jet head 17.

Also, the extrusions 45 and 46 of the ink tank 19 corresponding to the holes 48 and 49 (see FIG. 3) for use of fixing the supporting member 39 on the side face of the ink tank 19 are made longer than each of the extrusions 44. Then, the portions of these extrusions that penetrate the supporting member 39 are thermofused to enable the supporting member 39 to be fixed to the side face thereof. Given the straight line which is perpendicular to the straight line L1 to run on the extrusion 45 as L3, and the straight line that runs on the extrusion 46 as L2, the coupling condition between the ink supply port 69 and the ink supply tube 52 (see FIG. 3) is stabilized, because the center of the ink supply port 69 is positioned substantially on the straight line L3, hence reducing the load that may be given to this coupling condition even if the ink tank falls or shock is given to it. Also, the straight line L2 and the straight line L3 are not in agreement with each other, while the extrusions 45 and 46 are present on the circumference of the extrusion 44 on the discharge port 30 side of the ink jet head 17. Then, this arrangement produces a further effect that may enforce the positioning of the ink jet head 17 with respect to the ink tank 19.

The straight line L4 shown in FIG. 5 indicates the outer wall position of the ink supply member 60 when installed. As the extrusions 45 and 46 are arranged along the straight line L4, a sufficient strength and positional precision are provided against the structural weight on the leading end side of the ink jet head 17. The front fringe 77 of the ink tank 19 is inserted into the hole of the front plate 78 (see FIG. 6) of the carriage 7. This fringe is arranged to cope with the abnormal condition in which the displacement of the ink tank 19 becomes extremely unfavorable. The fall-off stopper 79 of the carriage 7 is arranged for the bar (not shown) of the carriage 7 to form a protection member capable of maintaining the state of installation even if the force may act in the upward direction to allow the ink jet cartridge 16 to leave the set position unexpectedly when the cartridge advances below the bar in a position where it is rotationally installed to be described later.

The ink tank 19 is formed to enclose the ink jet unit 18 with the exception of the lower aperture thereof when the ink tank is covered by the cover member 58 after the ink jet unit 18 is installed. However, as the ink jet cartridge 16, the ink tank forms a space that encloses four directions essentially, because the aforesaid lower aperture, which is arranged to mount the carriage 7 on it, is close to the carriage 7. Therefore, the heat generated by the ink jet head 17 in this enclosed space effectively functions in that it makes this space the one to retain heat. Nevertheless, this space may cause a slight temperature rise if the head is used continuously for a long time. Now, therefore, in accordance with the present embodiment, a slit (aperture) 80 having a smaller width than that of the enclosed space is arranged on the upper surface of the ink jet cartridge 16 in order to promote the natural heat radiation of the supporting member 39. With the slit 80 thus arranged, it becomes possible to uniformalize the temperature distribution of the ink jet unit 18 as a whole irrespective of use environment, while preventing the temperature from rising as described above.

With the assembled ink jet cartridge 16, ink is supplied from the interior of the cartridge 66 to the interior of the ink supply member 60 through the ink supply port 69, the hole 53 of the supporting member 39, and the inlet port arranged for the inner reverse side of the ink supply member 60. After passing the interior of the ink supply member 60, ink is allowed to flow into the common liquid chamber 33 (see FIG. 4) from the outlet port of the ink supply member 60 through the respective supply tube, the ceiling plate 34, and the ink receiving port 35. The connecting portions for use of ink communication in the above passage are sealed by use of silicon rubber, butyl rubber, or some other packing or sealed by means of pressurized fitting. With such sealing structure, the ink supply passage is secured.

As described earlier, the ink supply unit 60, the ceiling plate 34 and discharge port plate 36, and the cartridge main body 66 are formed integrally as each molded component, respectively. Therefore, not only, the assembling accuracy becomes higher, but also, the quality of the components is effectively enhanced significantly when manufactured in a large scale. Also, as compared with the conventional example, the number of parts is reduced to make it possible to demonstrate the excellent characteristics thereof reliably as desired.

Also, in accordance with the present embodiment, it is arranged as shown in FIG. 2 that after an ink jet cartridge 16 is assembled, the gap 83 is made between the upper surface portion 81 of the ink supply member 60 and the end portion of roofing member 82 of the ink tank 19 having a thin and long aperture (slit) 80 formed therefor. Likewise, a gap (not shown) is formed between the lower face portion 84 (see FIG. 3) of the ink supply member 60 and the head side end portion of the thin plate member 85 below the location where the cover member 68 of the ink tank 19 is installed. These gaps are made to promote the heat radiation effect of the aforesaid aperture 80, and at the same time, prevent the unwanted force that may be given to the ink tank 19 from affecting the ink supply member 60 or the ink jet unit 18 directly.

Now, mainly with reference to FIG. 6, the description will be made of the operation to install the ink jet cartridge 16 on the carriage 7. FIG. 6 is a cross-sectional view which shows the structure whereby to install the ink jet cartridge on the carriage.

As shown in FIG. 6, the platen roller 11 guides a recording material 10, such as a recording sheet, in the direction from the back side of FIG. 6 to the front side thereof. The carriage 7 moves in the longitudinal direction (axial direction) of the platen roller 11. Then, for the carriage 7, there are arranged on the front side of the carriage 7, that is on the paten roller 11 side, a front plate 78 (in a thickness of 2 mm, for instance) which is positioned on the front side of the ink jet cartridge 16; a supporting plate 86 for use of electrical connection to be described later; and the hook 74 for use of positioning and fixing the ink jet cartridge 16 on a specific recording position.

The front plate 78 is provided with two extruded positioning surface 87 corresponding to the extrusions 50 and 51 (see FIG. 3) on the supporting member 39 of the ink jet cartridge 16 in order to receive the force perpendicular to the extruded surface 87 thereof after being installed on the ink jet cartridge 16. Then, on the platen roller 11 side of the front plate 78, a plurality of enforcement ribs (not shown) are arranged in the direction toward the aforesaid perpendicular force. These ribs extrude slightly to the platen roller 11 side (approximately 0.1 mm, for instance) more than the front portion L5 of the ink jet cartridge 16 when installed. These ribs function dually as the extrusions for use of head protection.

The supporting plate 86 is provided with a plurality of reinforcement ribs 88 that extend perpendicularly to the surface of FIG. 6. The heights of these ribs 88 are made gradually lower from the platen roller 11 side to the hook 74 side. In this manner, the ink jet cartridge 16 is installed in a state of being inclined as shown in FIG. 6. Also, the supporting plate 86 supports the flexible sheet 90 having the pads 89 corresponding to the pads 38 (see FIG. 3) of the wiring substrate 37 of the ink jet cartridge 16, and also, supports the rubber pad sheet 91 having dots that create elastic force to press each of the pads 89 from the reverse side thereof. The positioning surface 92 of the supporting plate 86 on the hook 74 side is arranged to face the extruded surface 87 to exert the acting force upon the ink jet cartridge 16 in the direction opposite to the acting direction of the extruded surface 87 in order to stabilize the electric connection between the pads 38 and the pads 89. Then, the pad contact region is formed between them, and it is arranged to regulate uniquely the amount of the deformation of the dots on the rubber sheet 91 with those dots that correspond to the pads 89.

The positioning surface 92 is in a state of butting the surface of the wiring substrate 37 (see FIG. 3) when the ink jet cartridge 16 is fixed on the recordable position. Now that the pads 38 are distributed to be symmetrical to the straight line L1 (see FIG. 5) as described earlier, the amount of deformation of each dot of the rubber sheet 91 with the dots becomes even, and the contact pressure between the pads 89 and the pads 38 is more stabilized. In accordance with the present embodiment, the distribution of the pads 38 is two lines each up and down, and two line in perpendicular. In FIG. 6, the hook 74 is provided with an elongated hole that engages with the fixed shaft 93. Then, utilizing the movable space provided by this elongated hole the hook positions the ink jet cartridge 16 with respect to the carriage 7 by moving to the left side toward the longitudinal direction of the platen roller 11 after being rotated in the counterclockwise from the position shown in FIG. 6.

The hook 74 may be made movable in any way, but it is preferable to arrange a structure to move the hook by use of a lever or the like. When the hook 74 rotates, the ink jet cartridge 16 moves to a position where the positioning extrusions 50 and 51 abut against the extruded surface 87 of the front plate 78, while moving toward the platen roller 11 side. By the shift of the hook 74 to the left side, the 90-degree hook surface 75 rotates on the horizontal plane centering on the contact region of the extrusions 50 and 51 of the ink jet cartridge 16 with the extruded surface 87, while being closely in contact with the 90-degree surface of the nail 76 of the ink jet cartridge 16. Then, lastly, the contact begins between the pads 38 and the pads 89. Thus, when the hook 74 is held in a specific position, that is, its fixing position, there are formed at a time the complete contact between the pads 38 and pads 89; the complete surface contact between the extrusions 50 and 51, and the extruded surface 87; the two-surface contact between the 90-degree surfaces of the hook 75 and nail 76; and the surface contact between the wiring substrate 37 (see FIG. 3) and the positioning surface 92. In this way, the ink jet cartridge 16 is positioned and held with respect to the carriage 7.

Figure 7:
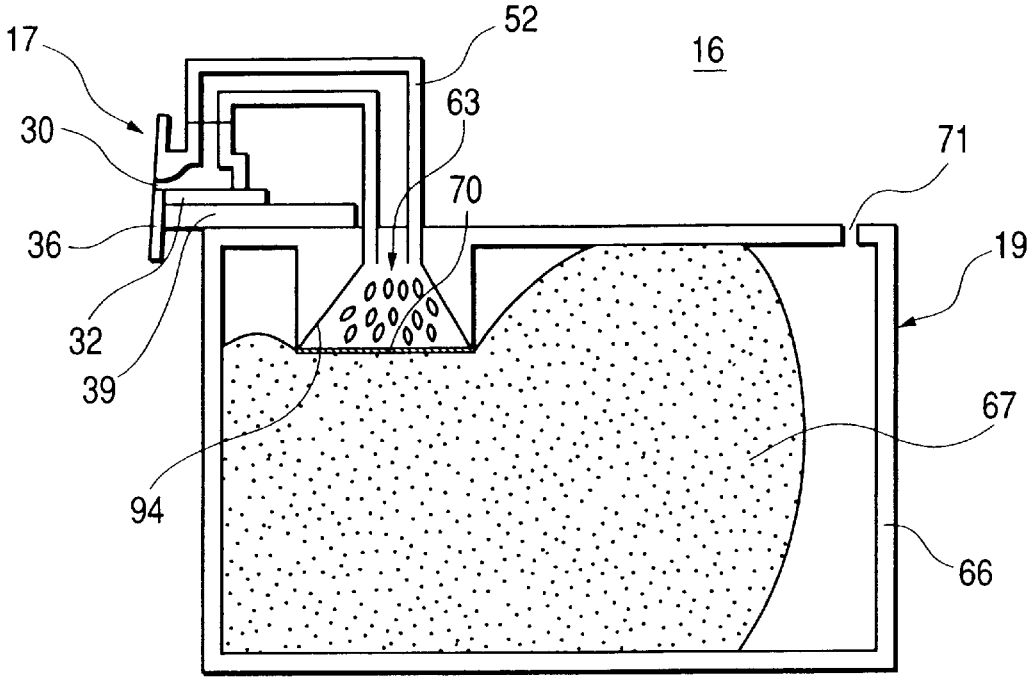
FIG. 7 is a vertically sectional view which shows schematically one example of the ink supply system for the ink jet cartridge.

FIG. 7 is a vertically sectional view which schematically shows one example of the ink supply system of the ink jet cartridge described above.

As shown in FIG. 7, the end portion of the ink supply tube 52 forms the ink inlet port 94. Then, a filter 70 is welded to this end portion. The filter 70 abuts against the ink absorbent 67. The ink inlet port 94 is tapered because the diameters of the ink supply tube 52 and filter 70 are different. On the inner face of the tapered ink inlet port 94, a plurality of small extrusions 63 are arranged as agitating means for agitating ink that flows in the ink supply tube 52.

These small extrusions 63 are formed thin and long, and arranged radially in the direction toward the center of the tapered face, that is, toward the ink supply tube 52. Also, along the circumference of the tapered face, plural extrusions are arranged as the first extrusion group, but interrupted on the way. Then, after the interrupted portion, another extrusion group is arranged anew radially. Each of the small extrusions 63 of this extrusion group is formed so that each of them is arranged alternately between each of the small extrusion 63 of the first extrusion group with respect to the direction of ink flow.

Figure 8:
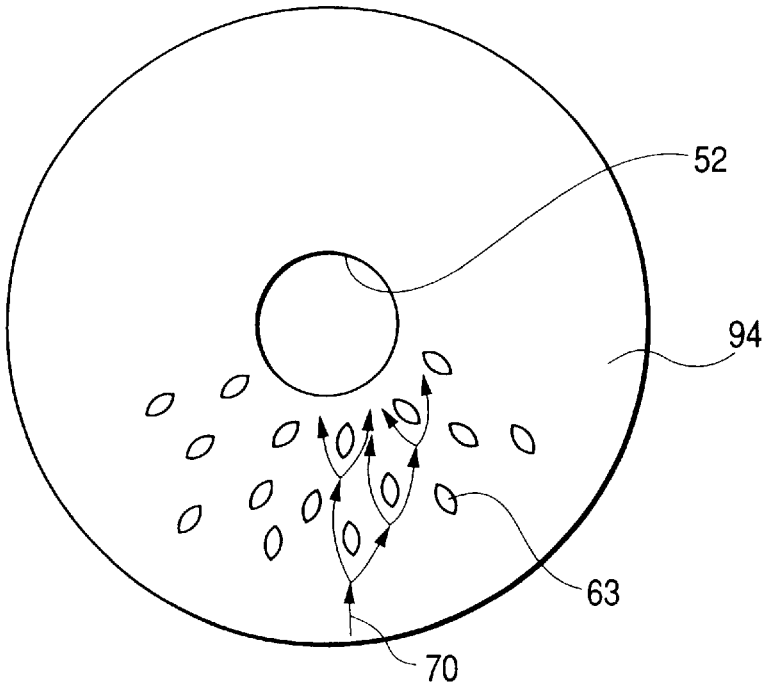
FIG. 8 is a plan view which shows the inner face of the ink inlet port represented in FIG. 7 in a state that the filter is removed.

FIG. 8 is a plan view which shows the inner face of the ink inlet port represented in FIG. 7 in a state that the filter is removed.

As FIG. 8 is a plan view, each of the small extrusions 63 looks short. Actually however, it is longer than it looks. In FIG. 8, the example is shown in which ink flows along the tapered inner face of the ink inlet port 94. As shown in this example, each of the small extrusions 63 in a certain group is arranged between each of the small extrusion 63 of another extrusion group with respect to the direction of ink flow. Therefore, ink 70 that has passed between the extrusions of a certain extrusion group is divided into two by means of the next extrusion of another extrusion group. Thus, ink that flows along the inner wall face of the ink inlet port 94 passes the extrusion groups repeatedly. Ink is well agitated until it reaches the ink supply tube 52. As a result, the density of ink to be discharged from each of the discharge ports 30 of the discharge port array provided for the recording head 17 becomes even, hence making it possible to recording good images on a recording material 10 without uneven densities. Here, in FIG. 8, the structure is represented so that small extrusions are arranged a part of the tapered inner face. It is of course possible to arrange them all over the circumference thereof.

Figure 9:
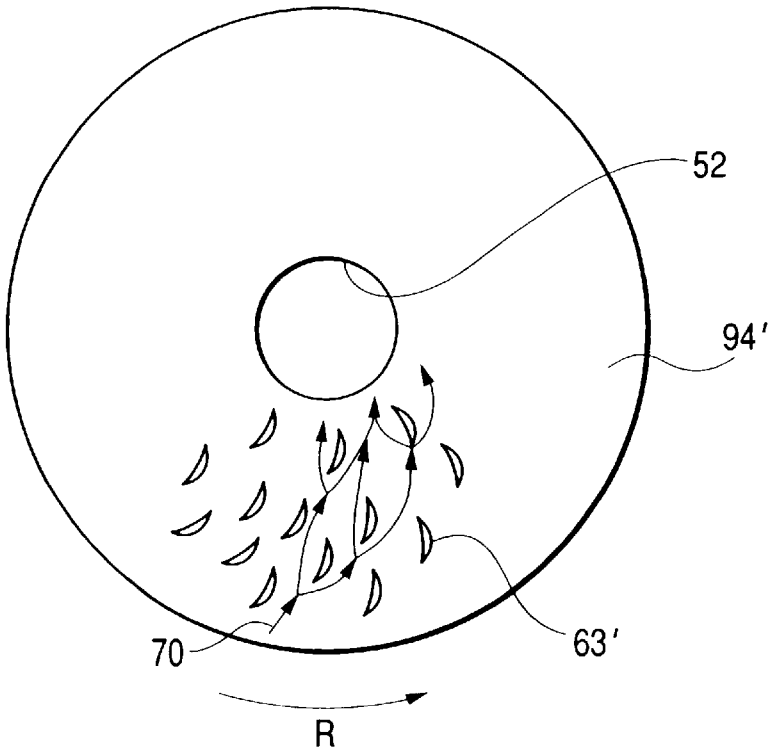
FIG. 9 is a plan view which shows another example of the inner surface of the ink inlet port in a state that the filter is removed.

FIG. 9 is a plan view which shows another example of the inner face of the ink inlet port in a state that the filter is removed.

In FIG. 9, not only each of the extrusion groups is directed toward the ink supply tube 52, but also, the shape and arrangement direction of small extrusions 63' serving as agitating means are devised so that the ink flow also occurs in the circumferential direction R of the ink inlet port 94'. In this case, the ink flow is not only divided into two simply, but ink flows spirally in the circumferential direction of the ink inlet port 94' and flows into the ink supply tube 52. As a result, ink is agitated effectively even in the ink supply tube 52. Here, in FIG. 9, the small extrusions 63' are arranged only on a part of the tapered inner face as in the case shown in FIG. 8, but it may be possible, of course, to arrange the structure so that the small extrusions are provided for the entire circumference thereof.

Figure 10:
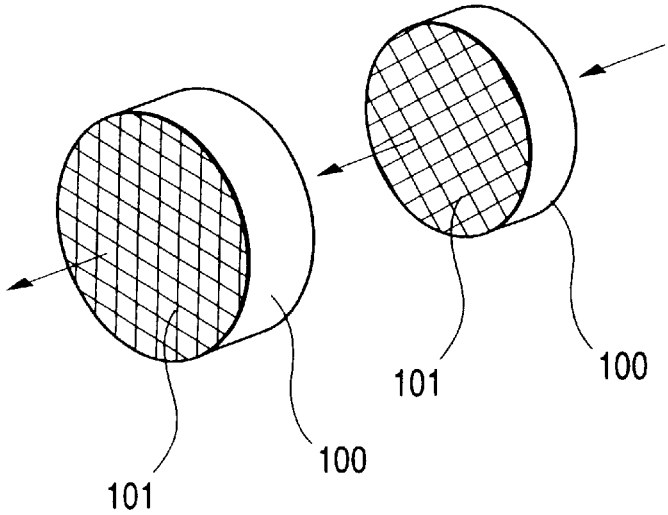
FIG. 10 is a perspective view which shows an agitation member inserted into the ink supply tube represented in FIG. 3.

FIG. 10 is a perspective view which shows an agitation member inserted into the ink supply tube represented in FIG. 3.

FIG. 8 and FIG. 9 illustrate each of the structures in which small extrusions are arranged on the tapered inner face of the ink inlet port to effectuate agitation. Besides each of them, it may be possible to arrange a structure to effectuate agitation of ink flowing in the ink supply tube 52 (see FIG. 3) by inserting agitation members 100 serving as agitating means into the ink supply tube 52. Also, it may be possible to arrange small extrusions 63 either on a part of the ink inlet port or on the entire circumference thereof. It is preferable to arranged them on the entire circumference, because then there is no restriction imposed upon the installation direction of the cartridge.

As shown in FIG. 10, the flow paths in each of the agitation members 100 are divided by a fine latticework 101. A plurality of the agitation members 100 thus structured are combined one after another with the rotational direction of each square latticework 101 being deviated each other with respect to the ink flow direction in the ink supply tube 52. Thus, when ink passes a certain agitation member 100, the ink flow is divided by means of the square latticework 101. When the ink passes the next agitation member 100, the ink flow is further divided by the square latticework 101, hence agitating the ink that flows in the ink supply tube 52. Here, it is preferable to set the angle of deviation at approximately 45° between the square latticeworks 101 of adjacent agitation members 100. Also, in this case, if the thickness of the latticework 101 of the agitation member 100 on the ink flow-out side is larger than that of the latticework 101 of the agitation member 100 on the ink flow-in side, the ink agitation is made more effective when the latticeworks 101 are combined, respectively.

As described above, with a plurality of agitation members 100 thus inserted into the ink supply tube 52, it becomes possible to evenly agitate ink that flows from the filter surface into the ink supply tube 52, hence breaking the corresponding relations between the uneven ink concentration on the filter surface and the uneven ink concentration between each of the nozzles of the nozzle array. In this manner, the uneven density of images recorded on a recording material can be eliminated efficiently.

Figure 11A:
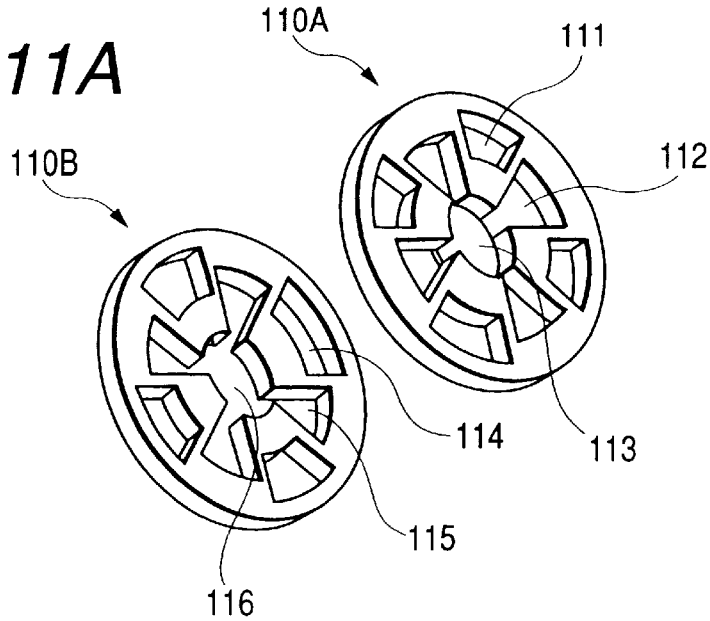
FIGS. 11A, 11B and 11C are views which illustrate another structure of the agitation members inserted into the ink supply tube represented in FIG. 3.
Figure 11B:
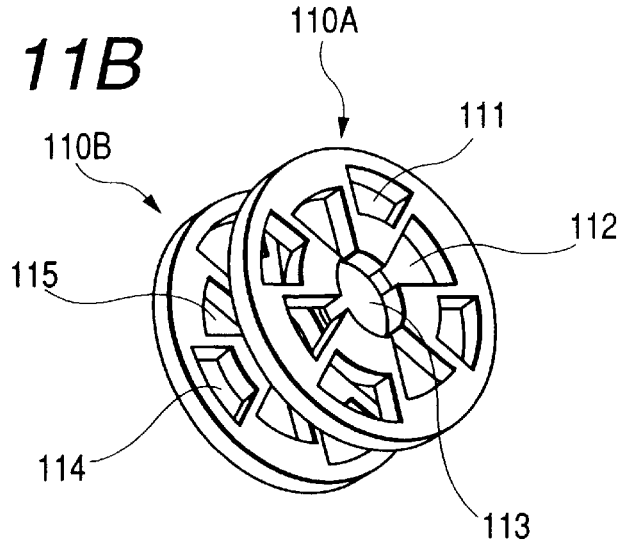
Figure 11C:
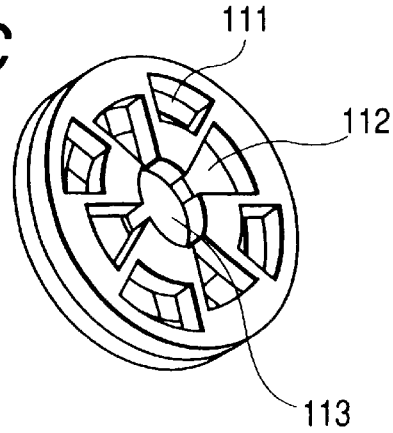

Also, FIGS. 11A to 11C illustrate another structure of the agitation members inserted into the ink supply tube 52.

Here, in order to make the structure readily understandable, the member shown in FIG. 11A is divided into two which are designated by the reference marks 110A and 110B, respectively. In practice, the member is used by combining the divided portions or it may be possible to mold them integrally in the combined form from the beginning as one part for use. In either case, the anticipated effect can be demonstrated when the members are used in the cylindrical ink path as shown in FIG. 11C. FIG. 11B is a supplementary view to show the positional relationship when the divided portions are put together. Here, for the member 110A, two kinds of through holes 111 and 112 are made. Then, a flow divider plate 113 is formed on the bottom face of the central axis. In FIGS. 11A to 11C, four through holes 111 are made at an angle of 90°. These through holes are formed on the outer circumference as compared with the through holes 112. On the other hand, the through holes 112 form a cross slightly on the inner circumference, having four fan type holes at an angle of 90°, which are connected by a hole arranged on the central axis. On the bottom of this hole the flow divider plate 113 is formed. The member 110B is exactly in the same shape as the member 110A with the exception of the flow divider plate, and arranged with a rotation of 45° to it. The holes 111 and 114 are the same shape, and the holes 112 and 115 are the same shape. The ink which flows in from the through holes 111 closer to the outer circumference in FIG. 11C flows further into the through holes 115 of the next block closer to the inner circumference, and also, into the hole 116 on the central axis. Also, the ink which flows into the through holes 112 is the one that flows closer to the inner circumference, as well as to the central axis. Particularly, the ink that flows closer to the central axis abuts against the flow divider plate 113 to flow toward the circumference and join together with the ink that flows into the holes 112. This ink flows in the through holes 114 closer to the outer circumference on the next block 110B. As described above, the member shown in FIG. 11C converts the flow running in the vicinity of the central axis to the one running along the outer circumference, and converts the flow along the outer circumference into the one running along the central axis. In accordance with this embodiment, the holes are in a shape which is divided into each at an angle of 45°, respectively, but the dividing angle may be set arbitrarily. Further, in FIG. 11C, it may be possible to combine members each at a deviated angle of 45°/2 (45° divided by 2) to the other one, thus mixing the flows on the center axis and outer circumference more minutely. Also, it may be possible to combine this arrangement with some other embodiments.

In this respect, the present invention is applicable to an ink jet recording apparatus that adopts recording means (recording head) using electromechanical transducing elements, such as piezo-elements. However, the invention demonstrates excellent effect particularly with an ink jet recording apparatus that adopts a the method for discharging ink by the utilization of thermal energy. With the method of the kind, it becomes possible to attain a highly precise recording in high density.

As regards the typical structure and operational principle of such method, it is preferable to adopt those which can be implemented by the application of the fundamental principle disclosed in the specifications of U.S. Pat. Nos. 4,723,129 and 4,740,796, for example. This method is applicable to the so-called on-demand type recording and a continuous type one as well. Here, in particular, with at least one driving signal that corresponds to recording information, the on-demand type provides an abrupt temperature rise beyond nuclear boiling by each of the electrothermal transducing elements arranged for a sheet or a liquid path where liquid (ink) is retained. Then, thermal energy is generated by each of the electrothermal transducing elements, hence creating film boiling on the thermal activation surface of recording means (recording head) to effectively form resultant bubbles in liquid (ink) one to one corresponding to each of the driving signals.

Now, by the development and contraction of each bubble, the liquid (ink) is discharged through each of the discharge openings, hence forming at least one droplet. The driving signal is more preferably in the form of pulses because the development and contraction of the bubble can be made instantaneously and appropriately to attain performing particularly excellent discharges of liquid (ink) in terms of the response action thereof. The driving signal in the form of pulses is preferably such as disclosed in the specifications of U.S. Pat. Nos. 4,463,359 and 4,345,262. In this respect, the temperature increasing rate of the thermoactive surface is preferably such as disclosed in the specification of U.S. Pat. No. 4,313,124 for an excellent recording in a better condition.

As the structure of the recording head, there are included in the present invention, the structure such as disclosed in the specifications of U.S. Pat. Nos. 4,558,333 and 4,459,600 in which the thermal activation portions are arranged in a curved area, besides those which are shown in each of the above-mentioned specifications wherein the structure is arranged to combine the discharging openings, liquid paths, and the electrothermal transducing devices (linear type liquid paths or right-angled liquid paths). In addition, the present invention is effectively applicable to the structure disclosed in Japanese Patent Application Laid-Open No. 59-123670 wherein a common slit is used as the discharging openings for plural electrothermal transducing devices, and to the structure disclosed in Japanese Patent Application Laid-Open No. 59-138461 wherein an aperture for absorbing pressure waves of thermal energy is formed corresponding to the discharge openings. In other words, by the application of the present invention, it becomes possible to perform recording reliably and more effectively irrespective of the modes of the recording heads.

Further, the present invention can be utilized effectively for the full-line type recording head the length of which corresponds to the maximum width of a recording medium recordable by such recording apparatus. For the full-line type recording head, it may be possible to adopt either a structure whereby to satisfy the required length by combining a plurality of recording heads or a structure arranged by one integrally formed recording head.

Also, for the present invention, it is preferable to additionally provide a recording head with recovery means and preliminarily auxiliary means as constituents of the recording apparatus because these additional means contribute to making the effectiveness of the present invention more stabilized. To name them specifically, these are capping means, cleaning means, suction or compression means, pre-heating means such as electrothermal transducing devices or heating devices other than such transducing devices or the combination of those types of devices. Here, also, the performance of a pre-discharge mode whereby to make discharge other than the regular discharge is effective for the execution of stable recording.

Also, the present invention is extremely effective in applying it not only to a recording mode in which only main color such as black is used, but also to an apparatus having at least one of multi-color modes with ink of different colors, or a full-color mode using the mixture of the colors, irrespective of whether the recording heads are integrally structured or it is structured by a combination of plural recording heads.

Moreover, as the mode of the recording apparatus in accordance with the present invention, it may be possible to adopt a copying apparatus combined with a reader, in addition to the image output terminal for a computer or other information processing apparatus, and also, it may be possible to adopt a mode of a facsimile equipment having transmitting and receiving functions.

Also, for the present invention, it is preferable to additionally provide a recording head with recovery means and preliminarily auxiliary means as constituents of the recording apparatus because these additional means contribute to making the effectiveness of the present invention more stabilized. To name them specifically, these are capping means, cleaning means, suction or compression means, pre-heating means such as electrothermal transducing devices or heating devices other than such transducing devices or the combination of those types of devices. Here, also, the performance of a pre-discharge mode whereby to make discharge other than the regular discharge is effective for the execution of stable recording.

Also, the present invention is extremely effective in applying it not only to a recording mode in which only main color such as black is used, but also to an apparatus having at least one of multi-color modes with ink of different colors, or a full-color mode using the mixture of the colors, irrespective of whether the recording heads are integrally structured or it is structured by a combination of plural recording heads.

Moreover, as the mode of the recording apparatus in accordance with the present invention, it may be possible to adopt a copying apparatus combined with a reader, in addition to the image output terminal for a computer or other information processing apparatus, and also, it may be possible to adopt a mode of a facsimile equipment having transmitting and receiving functions therefor.

As has been described above, in accordance with the present embodiment, it becomes possible to break the corresponding relationship of ink concentrations on the row of ink discharge ports 30 (discharge port array) and the filter of the ink inlet port 94, thus eliminating the density unevenness of recorded images due to the provision of the ink the concentration of which has changed in the ink absorbent 67.

In this respect, the description has been made of the elimination of uneven concentrations that may occur in the ink absorbent 67 along the sedimental phenomenon of pigment ink. However, even when dyestuff ink is used, there may occur in the ink absorbent 6 the uneven concentration that is not ignorable if an ink jet recording head is exposed to a low temperature so that moisture in ink is selectively frozen to bring about the relative condensation of the dyestuffs and the components of solvent. Therefore, the present embodiment is also effective even in a case where dyestuff ink is used, that is, the present embodiment is effectively applicable to the solution of the problem in a case where uneven concentrations are caused to occur in the ink absorbent 67 by some reasons.

As has been described, in accordance with the present invention, agitating means is provided for the ink supply path to agitate the ink that runs in the ink supply path when supplying ink to an ink jet recording head that performs recording images on a recording medium by discharging ink from the ink discharge ports. Therefore, ink is supplied to the ink jet recording head in a state of being agitated to make it possible to uniform the concentrations of ink to be discharged from each of the discharge ports of the discharge port array arranged for the recording head, hence recording good images on a recording medium without the uneven densities thereof.

What is claimed is:

1. An ink supply mechanism for supplying a pigment ink comprising:

an ink supply path to supply ink contained in an ink container to an ink jet recording head for recording images on a recording medium by discharging ink from a discharge port; and an ink flow changing structure provided in said ink supply path to change and alternate an ink flow in a plurality of different directions and agitate a flow of the ink flowing in said ink supply path.

2. An ink supply mechanism according to claim 1, wherein said ink flow changing structure is comprised of a plurality of extruding members extruded inwardly, the extruding members being provided to an inner wall of said ink supply path and shifted from each other with respect to an ink flow direction.

3. An ink supply mechanism according to claim 2, wherein said extruding members are shaped to generate an ink flow in a direction orthogonal to a direction from the ink container toward the ink jet recording head.

4. An ink supply mechanism according to claim 2, wherein said extruding members are arranged at an inlet port of said ink supply path.

5. An ink supply mechanism according to claim 3, wherein said extruding members are arranged at an inlet port of said ink supply path.

6. An ink supply mechanism according to claim 1, wherein said ink flow changing structure is comprised of a lattice-like member, and wherein a plurality of lattice-like members are arranged in an ink flow direction, and wherein a member constituting the lattice-like member is formed thin upstream of an ink flow direction and thick downstream of said ink flow direction.

7. An ink supply mechanism according to claim 1, wherein said ink flow changing structure is comprised of a combination of a structure for changing an ink flow at an inner wall side of the ink supply path to a center and a structure for changing an ink flow at a central portion of the ink supply path to the inner wall side.

8. An ink supply mechanism according to claim 6, wherein a deviation angle of adjacent ones of the plural lattice-like members is approximately 45° in a circumferential direction of said ink supply path.

9. An ink supply mechanism according to claim 7, wherein a deviation angle of said structures for changing ink flow at the inner wall side and the central portion, respectively, is approximately 45° in a circumferential direction of said ink supply path.

10. An ink supply mechanism according to any one of claims 1 to 9, wherein said ink container is provided with an ink absorbent for absorbing said ink.

11. An ink jet cartridge comprising: an ink supply mechanism according to any one of claims 1 to 9; and an ink container retaining ink to be supplied to said ink jet recording head of said ink supply mechanism.

* * * * *